US008444500B2

(12) United States Patent
Erkkinen

(10) Patent No.: US 8,444,500 B2
(45) Date of Patent: May 21, 2013

(54) FULL SWING WEIGHT TRAINING APPARATUS

(76) Inventor: Philip Erkkinen, Derry, NH (US)

( * ) Notice: Subject to any disclaimer, the term of this patent is extended or adjusted under 35 U.S.C. 154(b) by 0 days.

(21) Appl. No.: 13/116,677

(22) Filed: May 26, 2011

(65) Prior Publication Data

US 2012/0302380 A1 Nov. 29, 2012

(51) Int. Cl.
*A63B 69/36* (2006.01)

(52) U.S. Cl.
USPC ..... 473/256; 473/226

(58) Field of Classification Search
USPC ..... 473/256, 226, 219, 437, 459
See application file for complete search history.

(56) References Cited

U.S. PATENT DOCUMENTS

| | | | | | |
|---|---|---|---|---|---|
| 2,608,409 | A | * | 8/1952 | Pinkerton | 473/256 |
| 3,427,020 | A | * | 2/1969 | Montour et al. | 482/105 |
| 3,521,883 | A | * | 7/1970 | Hamilton | 473/437 |
| 3,623,724 | A | * | 11/1971 | Lande | 473/437 |
| 3,716,239 | A | * | 2/1973 | Goudreau | 473/256 |
| 4,005,864 | A | * | 2/1977 | Stewart | 473/437 |
| 4,045,034 | A | * | 8/1977 | Thomas | 473/231 |
| 4,200,285 | A | * | 4/1980 | Petitti, Jr. | 473/437 |
| 4,538,812 | A | * | 9/1985 | Mugford et al. | 473/437 |
| 4,588,191 | A | * | 5/1986 | Stewart | 473/256 |
| 4,969,921 | A | | 11/1990 | Silvera | |
| 5,026,063 | A | | 6/1991 | Rhodes | |
| 5,050,877 | A | * | 9/1991 | Wales | 473/437 |
| 5,415,406 | A | | 5/1995 | Reichenbach et al. | |
| 5,460,378 | A | * | 10/1995 | Getts | 473/251 |
| 5,776,006 | A | * | 7/1998 | Gruber | 473/256 |
| 5,992,270 | A | | 11/1999 | Hedelin et al. | |
| 6,004,221 | A | | 12/1999 | Thornhill | |
| 6,083,116 | A | * | 7/2000 | Loredo | 473/256 |
| 6,599,201 | B1 | | 7/2003 | Grant | |
| 6,659,882 | B2 | | 12/2003 | Patsky | |
| 6,692,386 | B2 | | 2/2004 | Brundage | |
| 6,866,592 | B1 | | 3/2005 | Gitre | |
| 7,128,667 | B2 | * | 10/2006 | Nolan | 473/457 |
| 7,309,292 | B2 | * | 12/2007 | Tu Teng | 473/256 |
| 7,588,500 | B2 | * | 9/2009 | Hoeckl et al. | 473/256 |
| 7,686,711 | B2 | * | 3/2010 | Miller | 473/437 |
| 2001/0041622 | A1 | * | 11/2001 | Taylor | 473/201 |
| 2002/0128085 | A1 | * | 9/2002 | Kallassy | 473/256 |
| 2003/0224867 | A1 | * | 12/2003 | Ota | 473/256 |
| 2004/0009826 | A1 | | 1/2004 | Aisenberg | |
| 2004/0023726 | A1 | * | 2/2004 | Ritson et al. | 473/220 |
| 2006/0122000 | A1 | | 6/2006 | Paredes et al. | |
| 2006/0270487 | A1 | * | 11/2006 | Tu Teng | 473/256 |
| 2007/0021228 | A1 | * | 1/2007 | Flood | 473/226 |
| 2007/0066418 | A1 | * | 3/2007 | Adams | 473/256 |
| 2008/0146384 | A1 | * | 6/2008 | Hansen et al. | 473/437 |
| 2009/0191978 | A1 | * | 7/2009 | Hoeckl et al. | 473/256 |
| 2010/0137078 | A1 | * | 6/2010 | Liberatore | 473/437 |
| 2011/0275458 | A1 | * | 11/2011 | Estrada et al. | 473/437 |

OTHER PUBLICATIONS

Swingyde The Ultimate Golf Training Tool, 2011.

* cited by examiner

*Primary Examiner* — Raleigh W Chiu
(74) *Attorney, Agent, or Firm* — Z IP Law PLLC; Claire Zopf

(57) ABSTRACT

A weight training apparatus which develops strength, suppleness and memory in the muscles used for swinging of a sports implement which may be a baseball bat, tennis racquet, golf club or other sporting implement or equipment. More specifically, the trainer provides for normal use of the sport implement by a user to swing and hit an object such as a golf ball while providing shock absorption to reduce vibration and twisting of the implement upon impact with the object.

12 Claims, 8 Drawing Sheets

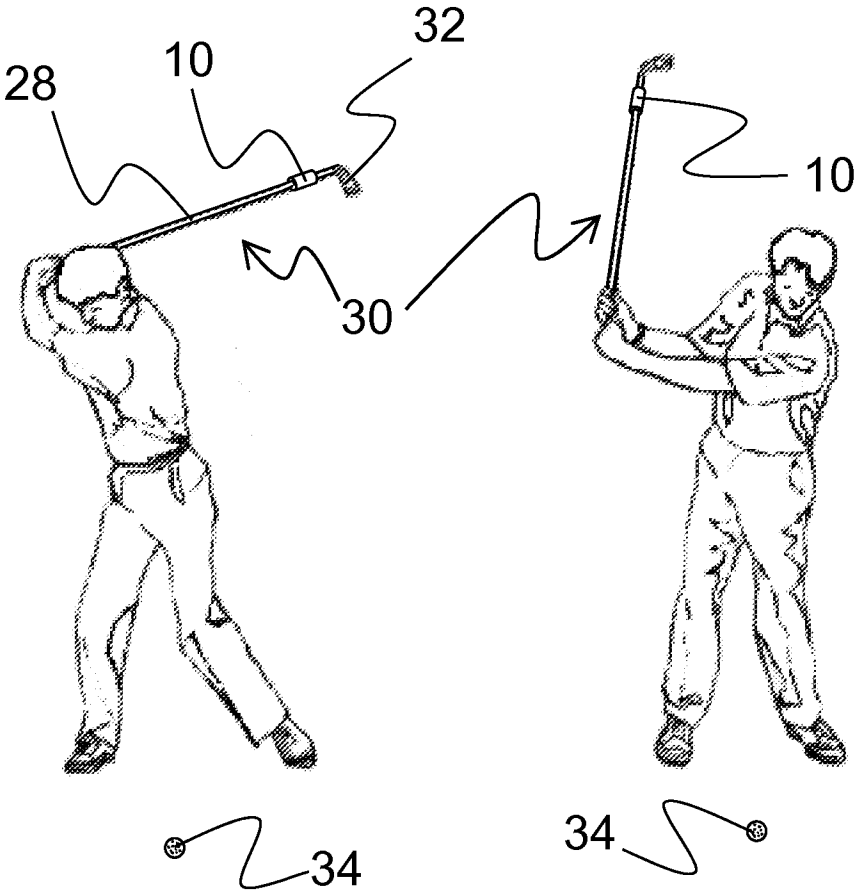
FIG. 6A
FIG. 6B
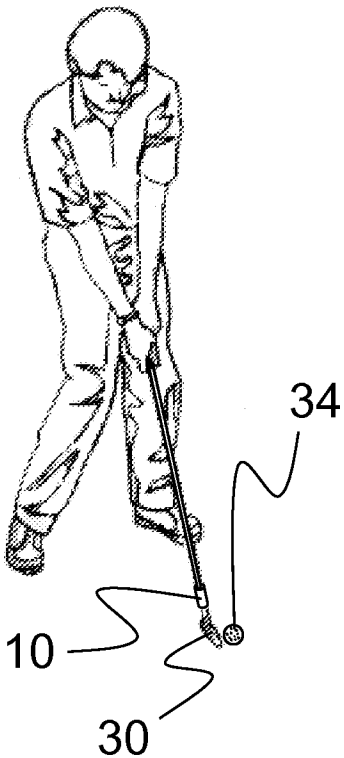
FIG. 6C

FULL SWING WEIGHT TRAINING APPARATUS

FIELD OF THE INVENTION

This invention relates to a weight training apparatus which develops strength, suppleness and memory in the muscles used for swinging of a sports implement which may be a baseball bat, tennis racquet, golf club or other sporting implement or equipment. More specifically, the trainer provides for normal use of the sport implement by a user to swing and hit an object such as a golf ball while providing shock absorption to reduce vibration and twisting of the implement upon impact with the object.

BACKGROUND OF THE INVENTION

Muscle development and muscle memory are important training techniques to improve strength and speed in the swinging of a sports implement and equipment. Many training devices exist for such sport implements for example baseball bats, lacrosse sticks, tennis racquets and golf clubs. After swinging a sport implement with a weighted device, and then removing the device a bat, racquet or club will feel lighter and quicker improving the speed of the club and providing for a ball to be hit more smoothly and for a longer distance. By employing weight resistance training methods using the weighted training device with a sport implement, muscle development, conditioning and timing of the user is often improved.

Among the available training devices are trainers using wind resistance as described in U.S. Pat. No. 6,866,592 to Gitre. In U.S. Pat. No. 6,692,386 to Brundage a specially made baseball bat or golf club having a hollow cavity that accepts one or more nested weights is described. As a further example a weighted fixture that mounts along the barrel or shaft of a sport implement is described in U.S. Patent Publication No. U.S.2006/0122000 to Paredes et al.

In U.S. Pat. No. 6,599,201 to Grant a portable weight training apparatus that is attached along the shaft near to the head of a golf club is described. The device holds one or more weights and has a front clamp, a rear clamp, an adjustable hand knob, and a threaded shaft with other components to secure the device to the shaft. A user may adjust the weight of the device by selecting the appropriate number of weights to mount and secure along the shaft.

Each of these training devices has significant limitations. For example, the wind resistance trainer of Gitre provides minimal weight resistance, needed to improve muscle tone. The specially designed club of Brundage requires a batter or golfer to use a completely different sport implement than would be normally used. Additionally, the weight device systems of Paredes et al. and Grant require significant preparation and adjustment to affix the apparatus to the sport implement. Further, a majority of these and other devices do not allow the sport implement to be used normally where the bat, racquet or club with the apparatus attached can for example be swung and used to hit a baseball, tennis ball or golf ball.

Normal use of the sport implement with the training attachment may be prevented due to the device covering a section of the implement used to contact the ball such as a donut used on a baseball bat. Using the implement normally may also be prevented where the additional weight of the training device twists the implement out of balance affecting the quality of the swing and the eye hand coordination necessary to properly contact a ball. Additionally, an added metallic device attached to the barrel or shaft of a sport implement may cause excessive vibration in the shaft of the implement resulting in a loss of grip and possibly pain in the hands of the user. What is needed is a weight training apparatus that is easy to attach to and remove from a sport implement and a device that provides for the sport implement to be used normally with the device attached without excessive twisting or vibration due to the added weight or material of the training device.

SUMMARY OF THE INVENTION

The present invention relates to a weight training device or trainer for a sport implement that adheres to a barrel, frame or shaft of for example a baseball bat, tennis racquet, or golf club. The device is of an elastomeric material that is positioned along a shaft or frame of the sports implement, and is easily affixed and removed from the implement. An internal compartment of the sport implement is filled with shock absorbing material to absorb vibrations of the barrel or shaft as the sport implement hits an object such as for example the head of a golf club contacts a golf ball. The trainer may be tubular in shape with a portion removed, providing for the elastomeric properties of the material to flex open and grip the training device around a barrel, frame or shaft of a sport implement.

An object of the invention is to increase muscle development and improve muscle memory through the use of a weighted training device that adheres to a barrel, frame or shaft of for example a baseball bat, tennis racquet, or golf club.

Another object of the invention is to increase the swinging speed of a sport implement through attachment and removal of the weight training device during an active sports regimen.

Another object of the invention is to provide for normal use of the sport implement in making contact with and hitting for example a baseball, tennis ball or golf ball with the weight training device attached.

Another object of the invention is to minimize the extension of the device out from a barrel, frame or shaft thereby maintaining proper balance of the sport implement reducing twisting of the sport implement while swinging.

Another object of the invention is to provide shock absorbing material within the weight training device in order to dissipate vibration.

A further object of the invention is the easy attachment and removal of the weight training device from the sport implement without the use of tools.

The present invention is directed to a training apparatus for sports equipment comprising a tube having an axial length defined about a main axis, the tube comprising a central passage extending the length of the tube, an inner wall and an outer wall, the outer wall having a greater diameter than the inner wall defining a space therebetween, a first radial wall connecting the inner and outer walls and extending the axial length of the tube, and a second radial wall spaced from the first axial wall also connecting the inner and outer walls and extending the axial length of the tube, an opening defined between the first and second radial walls and the opening communicating with the central passage, and a filling material provided in the space between the inner and outer walls of the tube.

The present invention also relates to a training device for a manually operated implement comprising a tube having an inner wall and an outer wall defined about a central passage, vibration dampening material contained within a compartment defined between the inner and outer wall, and a second passage communicating with the central passage through the inner and outer walls of the tube, the second passage extends along a length of the tube to allow passage of one of a shaft, barrel or frame of the manually operated implement into the central passage.

The present invention further relates to a method of modifying sports equipment to beneficially alter the weight of the equipment comprising the steps of providing a tube having an axial length defined about a main axis, the tube comprising, defining a central passage extending the length of the tube, forming an inner wall and an outer wall, the outer wall having a greater diameter than the inner wall defining a space therebetween, extending a first radial wall connecting the inner and outer walls and extending the axial length of the tube, and a second radial wall spaced from the first axial wall also connecting the inner and outer walls and extending the axial length of the tube, defining an opening between the first and second radial walls and the opening communicating with the central passage, and providing a filling material in the space between the inner and outer walls of the tube.

These and other features, advantages and improvements according to this invention will be better understood by reference to the following detailed description and accompanying drawings.

BRIEF DESCRIPTION OF THE DRAWINGS

Several embodiments of the present invention will now be described by way of example only, with reference to the accompanying drawings in which:

FIGS. 6A-6E is perspective view of a first embodiment of the weight training apparatus in use with a golf club to propel a golf ball;

DETAILED DESCRIPTION OF THE INVENTION

Figure 1:
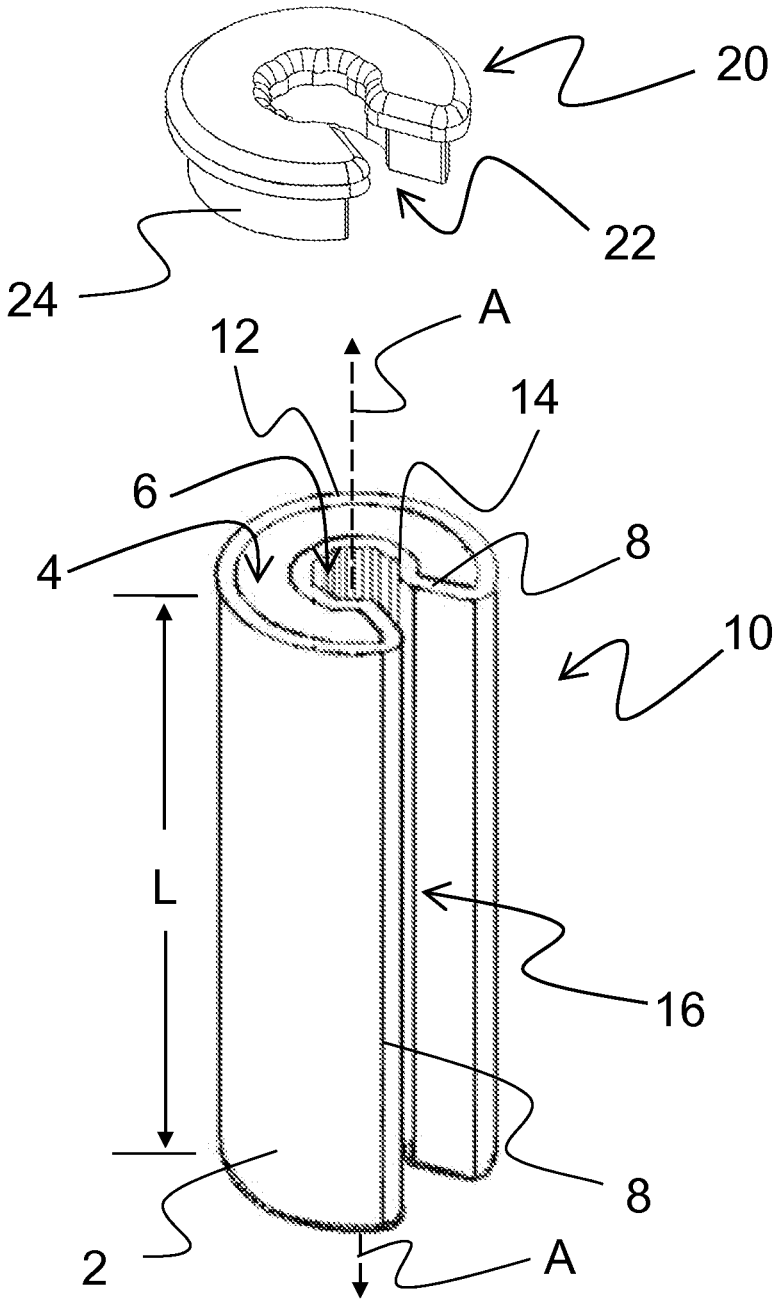
FIG. 1 is a perspective view of a first embodiment of a weight training apparatus for a sports implement.

A first embodiment of the weight training apparatus 10 is shown in FIG. 1. The apparatus or trainer 10 is a small, flexible crescent shaped tube 2 having an inner compartment 4 filled with a material or materials which has the effect of being shock absorbing. The trainer tube 2 is formed generally from a polymer material such as a substantially rigid, but slightly flexible material such as plastic or elastomeric material. Some types of plastics which may be used to make the tube include but are not limited to PET (PETE), polyethylene terephthalate, HDPE, high-density polyethylene, PVC, polyvinyl chloride, LDPE, low-density polyethylene, PP, polypropylene, and PS, polystyrene.

The tube 2 includes a sidewall defined by an outer wall 12 and an inner wall 14 being radially spaced apart and defined substantially concentric about a main axis A. The inner wall 14 has a diameter which defines a central passage 6 through the tube 2 about the axis A. The outer and inner walls 12, 14 have an axial length L extending between opposing ends of the tube 2. The axial length L between the ends of the tube 2 may be between 6.3 cm (2.5 in.) and 8.9 cm (3.5 in.) and is preferably about 7.6 cm (3.0 in.) in length. Through the sidewall and along the length L of the tube 2 between the opposing ends of the tube 2 is an axial opening 16 which also extends radially entirely through the sidewall defined by the spaced apart outer and inner walls 12, 14. The axial opening 16 provides a radial passage through the tube 2 that communicates with the central passage 6. On either side of the axial opening 16 are endwalls 8 which extend radially between the inner and outer walls 12, 14 on either side of the axial opening, essentially defining the axial opening 16, and also extend the length L of the tube 2 to the ends of the tube 2.

The substantially circumferential space defined between the outer and inner walls 12, 14 as well as the end walls 8 forms an inner compartment 4 as shown in FIG. 1. Where a desired material is to be maintained within the inner compartment 4 of the tube 2 a first sealed cap or stopper 20 is secured to one end of the tube 2 using glue or adhesive or a mechanical securing means such as threads or an engaging snap fit as known in the art. The end cap or stopper 20 may be of a similar elastomeric material as the trainer 10 with an axial opening 22, and extension walls 24 to insert into the inner compartment 4 to secure the stopper 20 to the tube 2.

Figure 2:
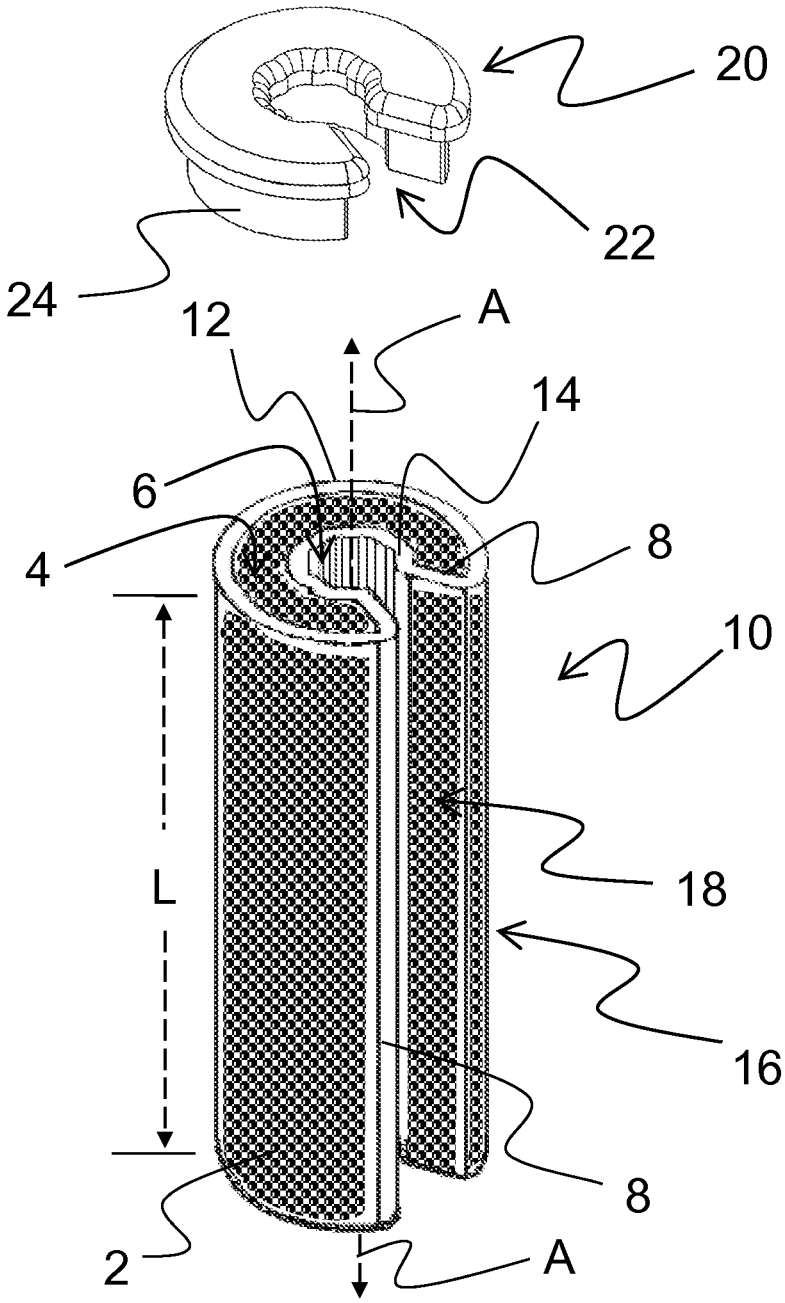
FIG. 2 is a perspective of a first embodiment of the weight training apparatus with fill material.

As shown in FIG. 2, the inner compartment 4 may be filled with a desired solid or semi-solid material such as a shock absorbing material 18 including but not limited to rubber, foam, plastic or metal beads or other elastically resilient polymers or materials that facilitate the absorption of any vibration of the sports implement on contact with the hitting of a ball or other sports object. It is to be appreciated that the desired material in the compartment 4 may even be a fluid such as oil or gel or some other fluid having a desired viscosity to facilitate the absorption of force transmitted through the tube 2. A second cap or stopper 21 is provided at the opposing end of the tube 2 to entirely enclose and seal the desired material within the compartment 4. The second stopper 21 may be glued, threaded or attached to the end of the tube 2 in any known manner. Alternatively, the tube 2 may be formed through a mold or other manufacturing process having a first end sealed, thereby forming a tubular container. The inner compartment 4 may be filled and sealed using a single stopper 20 or end cap.

Figure 3:
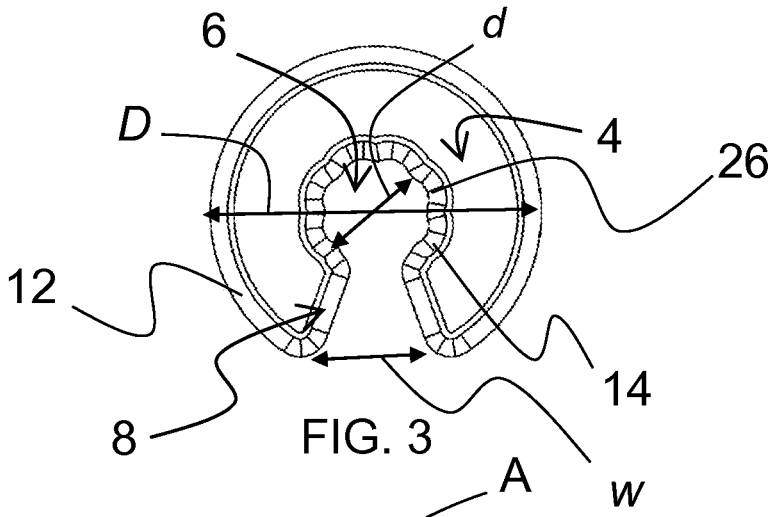
FIG. 3 is a top view of a first embodiment of the weight training apparatus.
Figure 4:
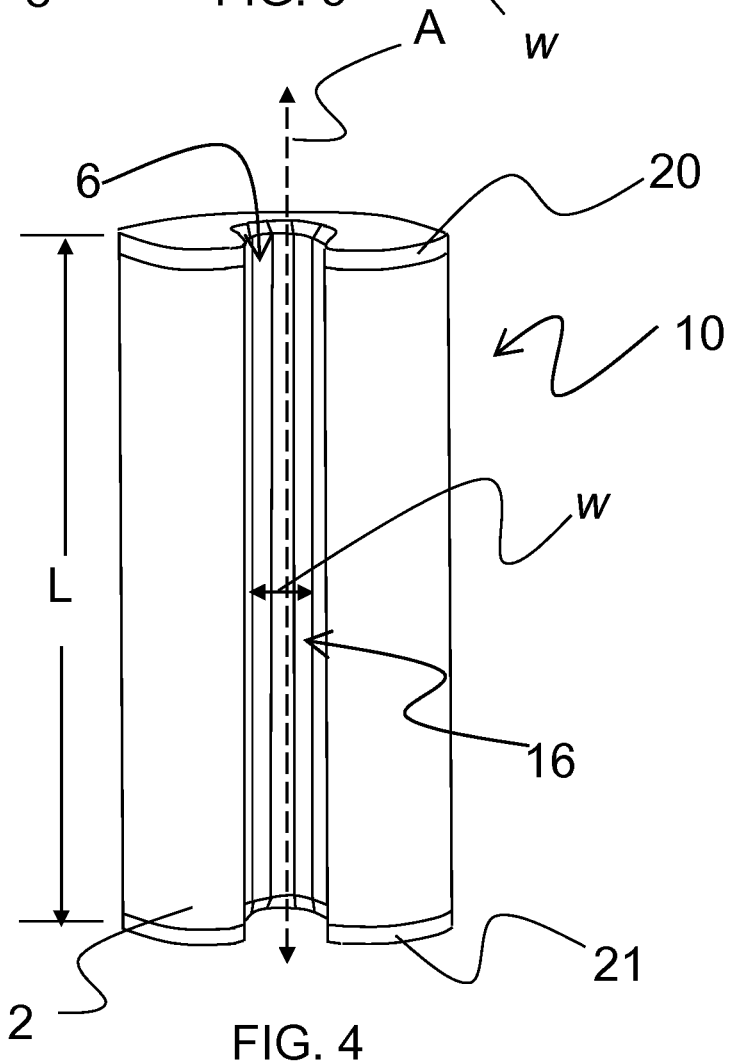
FIG. 4 is planar view of a first embodiment of the weight training apparatus.

A top plane view of the trainer 10 is shown in FIG. 3 and a front elevation view is shown in FIG. 4. The outer wall 12 of the tube 2 has an outer diameter D that is greater than an inner diameter d of the inner wall 14 to define the compartment 4. The outer diameter D in a preferred embodiment having a length of 2.89 cm (1.14 in) but may be at a dimension of for example from 2.54 cm (1.0 in.) to 3.81 cm(1.5 in.) with the overall dimension of the length L of the tube and the diameter D dependent upon the desired weight of the apparatus. As an example, for an outer diameter of 2.89 cm (1.14 in.) and the appropriate inner diameter to accommodate for example a golf club, a length L of 7.6 cm (3 in.) would provide a weight with a filled cavity of approximately 4.5 oz., roughly 1.5 oz. for every inch of length.

The inner diameter d is generally sized to frictionally engage with a desired size of sports implement on which the apparatus 10 is to be supported. In a first embodiment of the present invention the inner diameter d is further sized to define the central passage 6 which accommodates the tubular dimensions of a golf club as shown in FIG. 5. Standard golf club shaft diameters are 1.5 cm (0.600 in.)" at butt and 0.85 cm (0.335") at tip for woods and 0.94 cm (0.370") at tip for irons. A preferred dimension for the inner diameter d of the inner wall 14 in this embodiment would be approximately the same or slightly smaller than the above noted shaft tip diameters so that there is a slight frictional gripping of the inner wall 14 about the club shaft to facilitate the trainer 10 being maintained on the club shaft. Other sports implements can of course have different diameters leading to different inner diameters d for various embodiments of the invention.

Figure 5A:
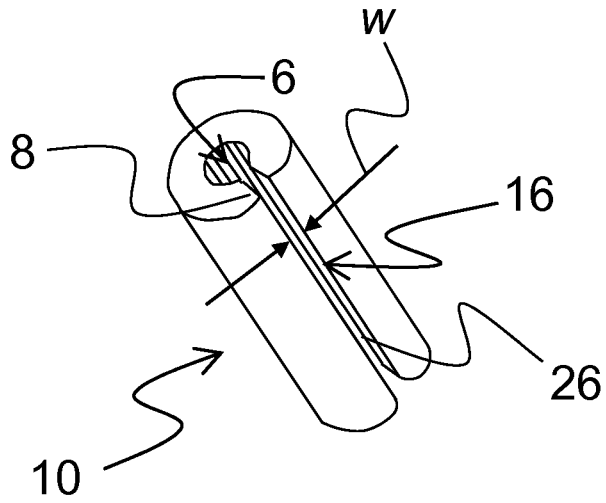
FIG. 5A is a perspective view of a first embodiment of the weight training apparatus in a normally closed position.
Figure 5B:
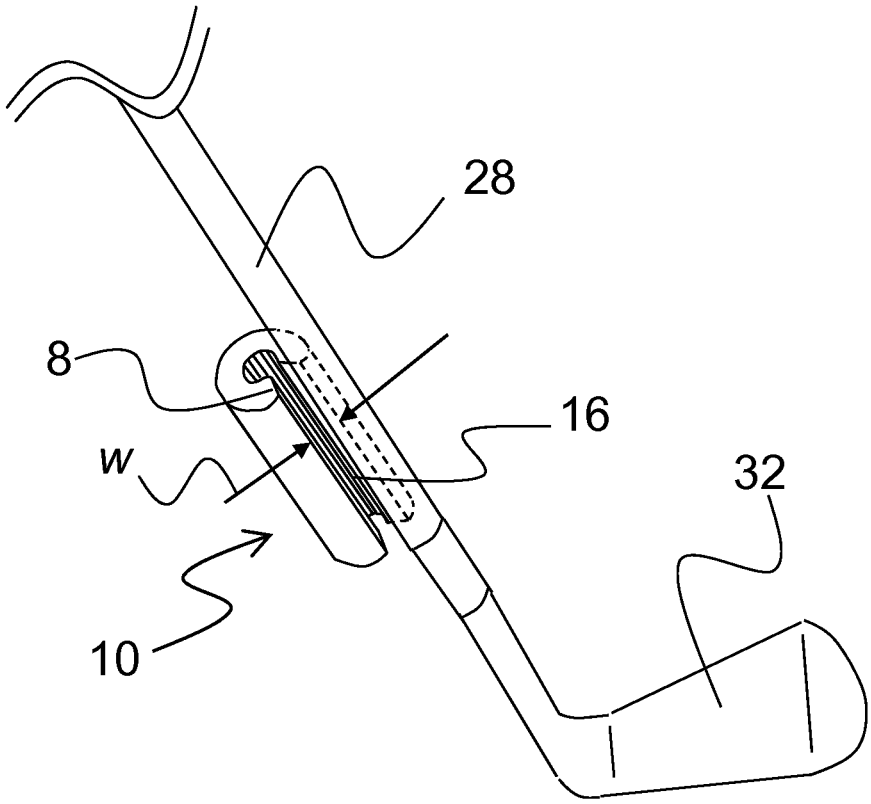
FIG. 5B is a perspective view of a first embodiment of the weight training apparatus in an open position being affixed to a golf club.
Figure 5C:
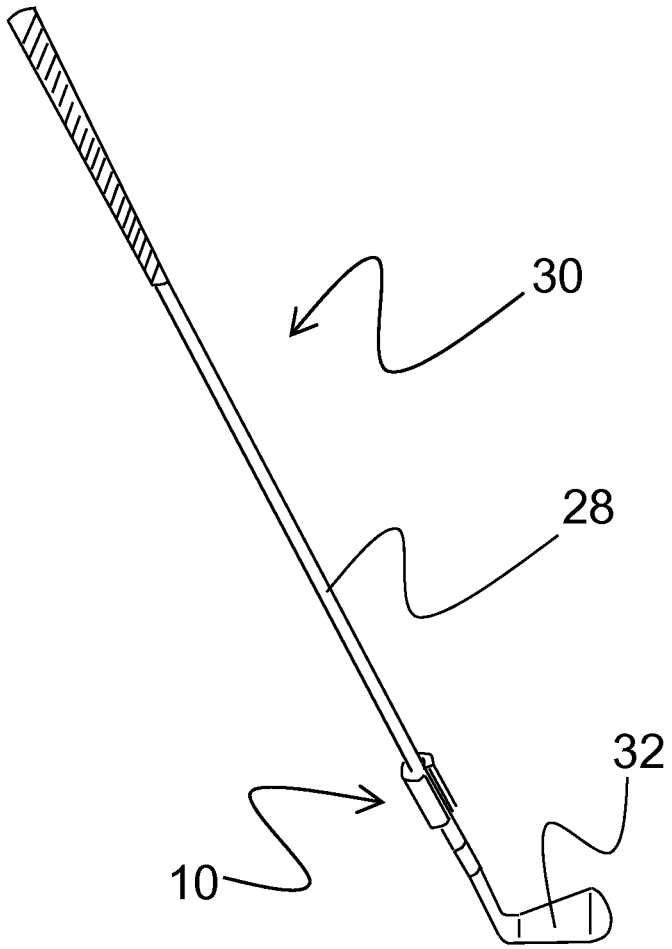
FIG. 5C is a perspective view of a first embodiment of the weight training apparatus in a normally closed position affixed to a golf club.

The axial opening 16 which as discussed above extends the length L of the trainer 10 and has a width w which is generally sized to be slightly smaller than the shaft diameter of for instance a golf club. Because the tube 2 has some inherent flexibility in the plastic or elastomeric nature of the tube material, the tube 2 including the outer and inner sidewalls 12, 14 are permitted some slight flex in a radial manner about the main axis A which allows the width w of the axial opening 16 to be biased into a slightly enlarged width w to allow for passage of for example the golf club shaft through the axial opening 16. In other words, the flexible nature and relatively loose material in the compartment 4 of the trainer 10 allows for the width w of the cutout portion 16 to expand from a first closed position as shown in FIG. 5A to an open position due to a force on the endwalls 8 by for example the shaft 28 of a golf club 30, or by a user manually forcing the endwalls 8 slightly farther apart, as sown in FIG. 5B and a return to the closed position adhering around the shaft 28 of a golf club 30 in FIG. 5C.

In this manner the trainer 10 is attached to the golf club 30 by simply aligning the axial opening 16 of the trainer 10 along the shaft 28 of the club at a point above the golf head 32 and applying pressure on the trainer 10 to force the axial opening 16 to open until the shaft 28 of the golf club 30 slips through the axial opening and into axial alignment with the trainer 10 inside the central passage 6. The inner wall 14 may be dimpled, ridged or have a plurality of protrusions 26 creating frictional points to better adhere the trainer 10 to the smooth metallic surface of a golf club 30 or other sports implement and prevent the trainer 10 from sliding up or down the shaft 28. The trainer 10 is also easily removed by grasping around the trainer 10 and the shaft 28 and pulling the trainer 10 away from the shaft 28. The cutout portion 16 separates and the shaft 28 is pulled away from the inner wall 14 and out through the cutout portion 16. No tools or external devices are necessary to attach or remove the trainer 10 from a sports implement.

The inner cavity 4 is substantially filled with a desired material such as a loose, uncompacted shock dampening or absorbing material 18 providing weight and force dissipating effects to the trainer 10. The trainer 10 may be of different length and dimensions to accommodate a larger amount of desired material 18 and thereby increase the overall weight of the trainer 10. A series of trainers may be provided at different weights to assist in a training program of lighter to heavier weights in order to gradually train and build muscle strength and memory. The desired material 18 may be for example loose metal shot or bearings that dampen vibrations by dissipating and damping the torsional and axial shaft forces caused by the impact of the club head 34 hitting the ball.

Figure 6E:
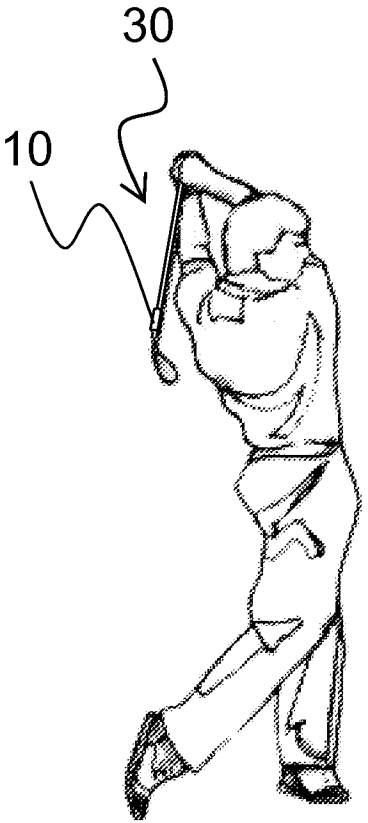
Figure 6D:
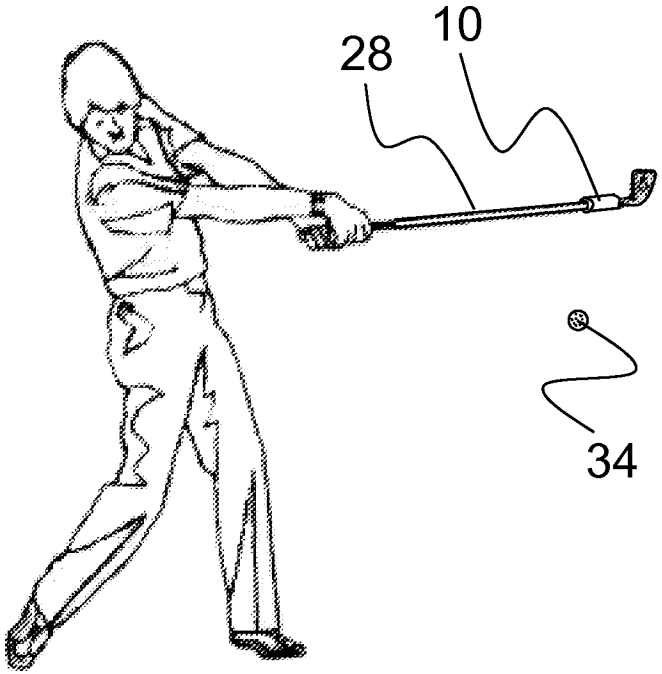

The position of the weight training apparatus 10 may be at different intermediate positions along the shaft 28 of the golf club 30 and with a very tight tolerance between the outer surface of the shaft 28 and the inner wall 14 of the trainer 10, essentially having no space or play therebetween, providing for swinging of the club 30 in a balanced manner thereby allowing for a normal swing as shown in FIGS. 6A-6E. Muscle acuity and tone is built up as the club is swung back normally as shown in FIG. 6A. The club 30 even with the additional weight of the trainer 10 can still be held and aligned over the golf ball 34 as shown in FIG. 6B without a drag or pull on the club 30 that may be caused by an extension of a weight training device away from the shaft as shown in some examples of the prior art. Contact with the golf ball 34 is made in a smooth even manner with any vibrations caused from the impact of club head 32 to the ball dissipated by the trainer 10 and the desired material 18. In examples of the prior art, a club cannot be swung in a normal even manner and the weight training device vibrates unevenly to the shaft causing pain within the palms of the golfer's hands as the club head 32 contacts a golf ball. With the weight training device 10 of the present invention the ball may be contacted and follow through of swing is completed in a smooth even manner as shown in FIG. 6D and FIG. 6E. The smoothness and normalcy of swinging the club with the training device 10 builds muscle memory and repetitive practice builds strength. By removing the weight training device 10, the club speed is increased as the club is still swung with the same smoothness but is lighter without the increased weight of the trainer 10.

Figure 8:
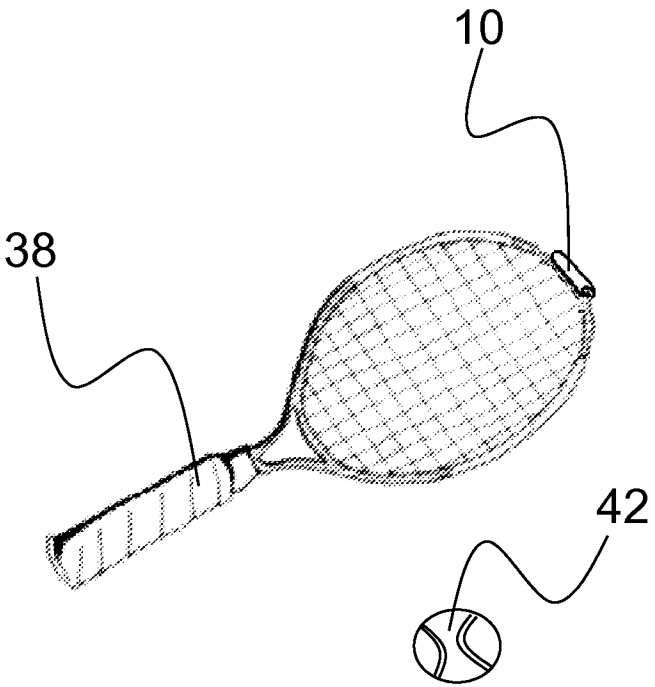
FIG. 8 is a still further embodiment of the weight training apparatus affixed to a tennis racquet.
Figure 7:
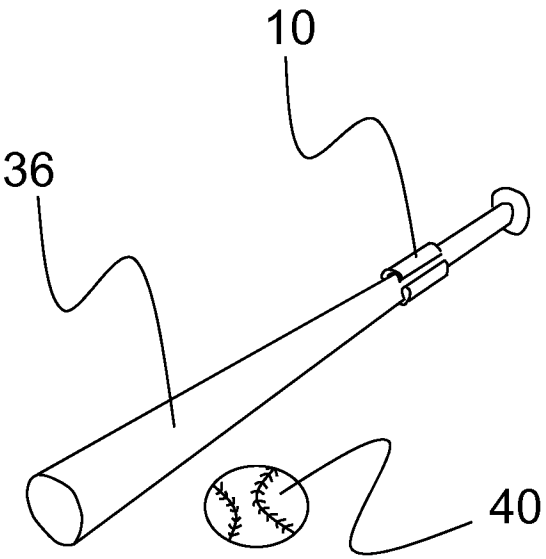
FIG. 7 is a further embodiment of the weight training apparatus affixed to a baseball bat.

The dimensions of the weight trainer 10, outer and inner walls 12, 14 and the compartment 4 may be modified to accommodate the attachment of the trainer 10 on a baseball bat 36 or tennis racquet 38 where a baseball 40 or tennis ball 42 may be hit normally with the trainer 10 attached as shown in FIG. 7 and FIG. 8.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention.

I claim:

1. A training apparatus for sports equipment comprising:

a tube having an axial length defined about a main axis, the tube comprising;

a central passage extending the length of the tube;

an inner wall and an outer wall, the outer wall having a greater diameter than the inner wall defining a space therebetween;

a first radial wall connecting the inner and outer walls and extending the axial length of the tube, and a second radial wall spaced from the first axial wall also connecting the inner and outer walls and extending the axial length of the tube;

an opening defined between the first and second radial walls and the opening communicating with the central passage; and a filling material provided in the space between the inner and outer walls of the tube.

2. The training apparatus for sports equipment as set forth in claim 1 wherein the axial opening extends the length of the tube between a first and second ends of the tube.

3. The training apparatus for sports equipment as set forth in claim 2 wherein the filling material provided in the space between the inner and outer walls of the tube is a plurality of separate articles.

4. The training apparatus for sports equipment as set forth in claim 2 wherein the filling material provided in the space between the inner and outer walls of the tube is a unitary article.

5. The training apparatus for sports equipment as set forth in claim 2 wherein the filling material provided in the space between the inner and outer walls of the tube is a single solid material.

6. The training apparatus for sports equipment as set forth in claim 2 wherein at least one of the first and second ends of the tube are sealed by at least one of a respective first and second end cap.

7. The training apparatus for sports equipment as set forth in claim 6 wherein the end cap is provided with a central passage and an axial passage substantially aligned with the central passage and axial passage of the tube.

8. The training apparatus for sports equipment as set forth in claim 1 wherein the tube is radially flexible to the extent that the axial passage can accommodate passage of an article wider than then a width of the axial passage therethrough.

9. A training device for a manually operated implement comprising;

a tube having an inner wall and an outer wall defined about a central passage;

vibration dampening material contained within a compartment defined between the inner and outer wall; and a second passage communicating with the central passage through the inner and outer walls of the tube, the second passage extends along a length of the tube to allow passage of one of a shaft, barrel or frame of the manually operated implement into the central passage.

10. The training device for the manually operated implement of claim 9 wherein the vibration dampening material has sufficient weight to increase the overall weight of the sport implement.

11. The training device for the manually operated implement of claim 9 wherein the compartment is attached around one of at least a shaft, barrel or frame of a sport implement without the use of a tool or other additional equipment.

12. The training device for the manually operated implement of claim 9 wherein the inner and outer walls of the tube are fabricated of a substantially rigid material but slightly flexible material such as plastic or elastomeric material to provide a variable diameter to the central passage of the tube.

* * * * *